US006488231B1

(12) United States Patent
Schoffl

(10) Patent No.: US 6,488,231 B1
(45) Date of Patent: Dec. 3, 2002

(54) MISSILE-GUIDANCE METHOD

(75) Inventor: Rainer Schoffl, Odenthal (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 0 days.

(21) Appl. No.: 09/719,865

(22) PCT Filed: Jun. 4, 1999

(86) PCT No.: PCT/EP99/03872

§ 371 (c)(1),
(2), (4) Date: Feb. 16, 2001

(87) PCT Pub. No.: WO99/66283

PCT Pub. Date: Dec. 23, 1999

(30) Foreign Application Priority Data

Jun. 18, 1998 (DE) ..... 198 27 168

(51) Int. Cl.[7] ..... G05D 1/12; F41G 7/00; F41G 7/30

(52) U.S. Cl. ..... 244/3.14; 244/3.11

(58) Field of Search ..... 244/3.1–3.17, 244/3.19, 3.2; 102/382–384

(56) References Cited

U.S. PATENT DOCUMENTS 4,143,836 A * 3/1979 Rieger ..... 244/3.15
4,238,090 A * 12/1980 French ..... 244/3.19
4,492,166 A * 1/1985 Purcell ..... 102/384

* cited by examiner

*Primary Examiner*—Bernarr E. Gregory
(74) *Attorney, Agent, or Firm*—Antonelli, Terry, Stout & Kraus, LLP

(57) ABSTRACT

The invention relates to a missile guidance method, more particularly for anti-armor projectiles fired directly at a target. In order to avoid missing a target by a narrow margin, the invention provides that the distance to the target (3) be measured with a range finder (8) before the projectile is fired. The flying time previously calculated on the basis of target distance is inputted to the projectile (1). The projectile (1) has one or several sensors which are activated after a predetermined flying time, said sensor or sensors determining whether the projectile (1) will fly over the target at a minimum distance. Optionally, the projectile (1) conducts a single trajectory adjustment with a fixed value.

8 Claims, 3 Drawing Sheets

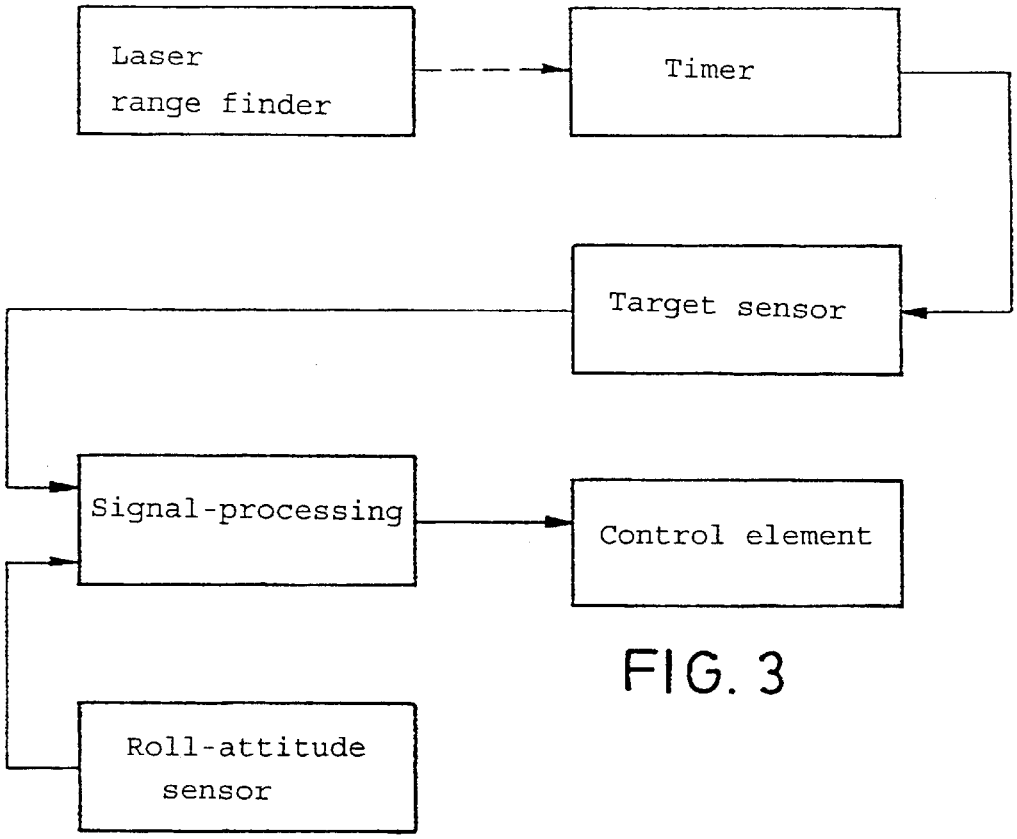
FIG. 3
FIG. 4
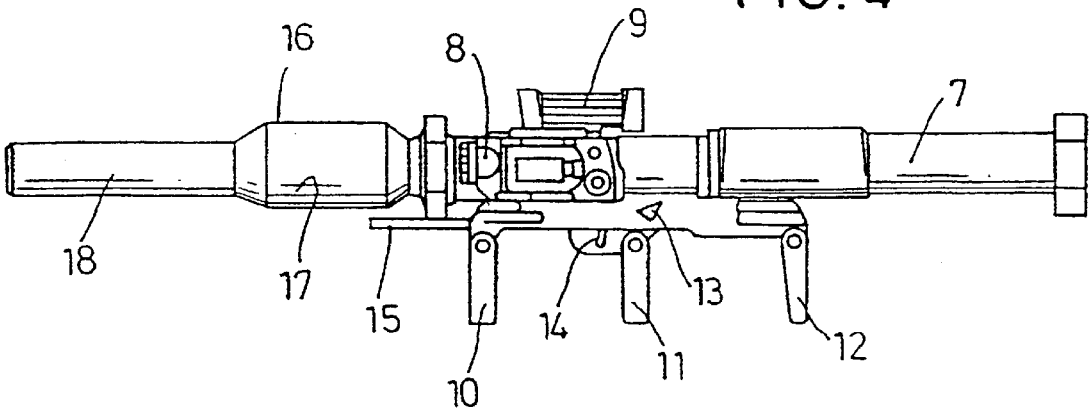

MISSILE-GUIDANCE METHOD

BACKGROUND OF THE INVENTION

The invention relates to a missile-guidance method and to a missile for carrying out the guidance method.

There are a wide variety of types of guided missile and these have a large number of guidance methods, as described, for example, in the book "Guided Weapons", R. G. Lee et al, published by Brassey's.

Besides missiles which are guided from launch, there are also so-called "terminally guided" missiles which, with the aid of a seeker head or with the aid of sensors, only locate and head for the target towards the end of their flying time (see NATO's Sixteen Nations, Special Edition, 1990).

In the case of missiles, such as, for example, unguided anti-armour projectiles, which only miss their target in a few cases, such guidance methods are too expensive for avoiding the small number of misses. A guidance method is therefore required which, by means of simple systems, avoids misses that only miss the target by a narrow margin.

SUMMARY OF THE INVENTION

A guidance method is proposed that is characterised in that

- before firing, the distance to the target is measured by means of a range finder,
- the precalculated flying time, is inputted into the missile on the basis of the target distance
- the missile is provided with one sensor or a plurality of sensors which are activated after a predetermined flying time,
- the sensor or sensors ascertains or ascertain whether the missile will fly past the target at a short distance therefrom, and
- if applicable, the missile carries out a single trajectory adjustment by a fixed amount.

Advantageously, the data transmission from the range finder to the missile is effected in a contact-free and without use of wires. As a result, no wiring is required, whereby possible damage is avoided.

Furthermore, advantageously the one sensor or the plurality of sensors is or are rigidly connected to the missile. The selected search range of the at least one sensor should be such that the target is detected as long as it is located in the trajectory-adjustment range of the missile.

An important feature is that the at least one sensor ascertains the direction in which the trajectory adjustment is to be effected.

A missile in accordance with the invention for carrying out this method is distinguished in that at least one rocket propulsion unit, which acts laterally for a short time, is used in order to control the missile (correct the missile shortly before impact).

Advantageously, the at least one sensor and the at least one rocket propulsion unit can be built onto existing missiles subsequently.

BRIEF DESCRIPTION OF THE DRAWINGS

FIG. 3 is a block diagram of the guidance method shown in FIG. 2.

DESCRIPTION OF THE INVENTION

Further features of the invention follow from the figures which are described below.

Figure 1A:
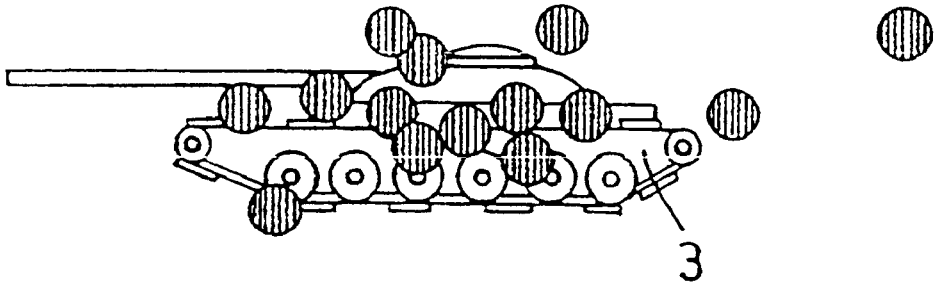
FIG. 1*a* shows the result of a hit simulation for an anti-tank shoulder weapon which fires a non-guided missile.

FIG. 1*a* shows the result of a hit simulation for an anti-tank shoulder weapon which fires a non-guided missile. It can be seen from this that, of 13 shots, 8 shots would have hit the target, a tank, 4 shots would have missed the target by a narrow margin and 1 shot would have missed the target by a long way. The reasons for the misses are due to a plurality of individual influencing variables, such as, for example, accuracy of the missile, aiming-error of the gunner, incorrect adjustment of the sight or a cross-wind.

Figure 1B:
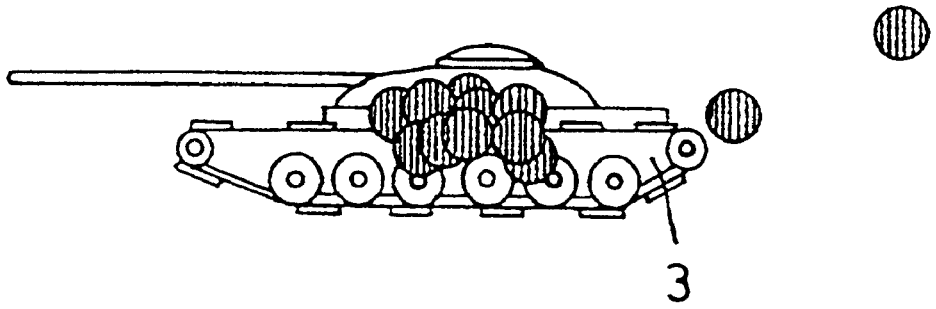
FIG. 1*b* shows the result of a hit simulation for an anti-tank shoulder weapon which fires a guided missile.

FIG. 1*b* shows the improvement in the striven for hit positions by means of a suitable guidance method, where misses by a narrow margin are avoided and hits in the marginal areas are shifted in the direction of the centre of the target. The miss that lies a long way behind the target, on the other hand, is not corrected. In comparison with FIG. 1*a,* in FIG. 1*b* the probability of hitting rises from 61.5% to 92.3%, that is, 1 miss in 13 shots.

Figure 2:
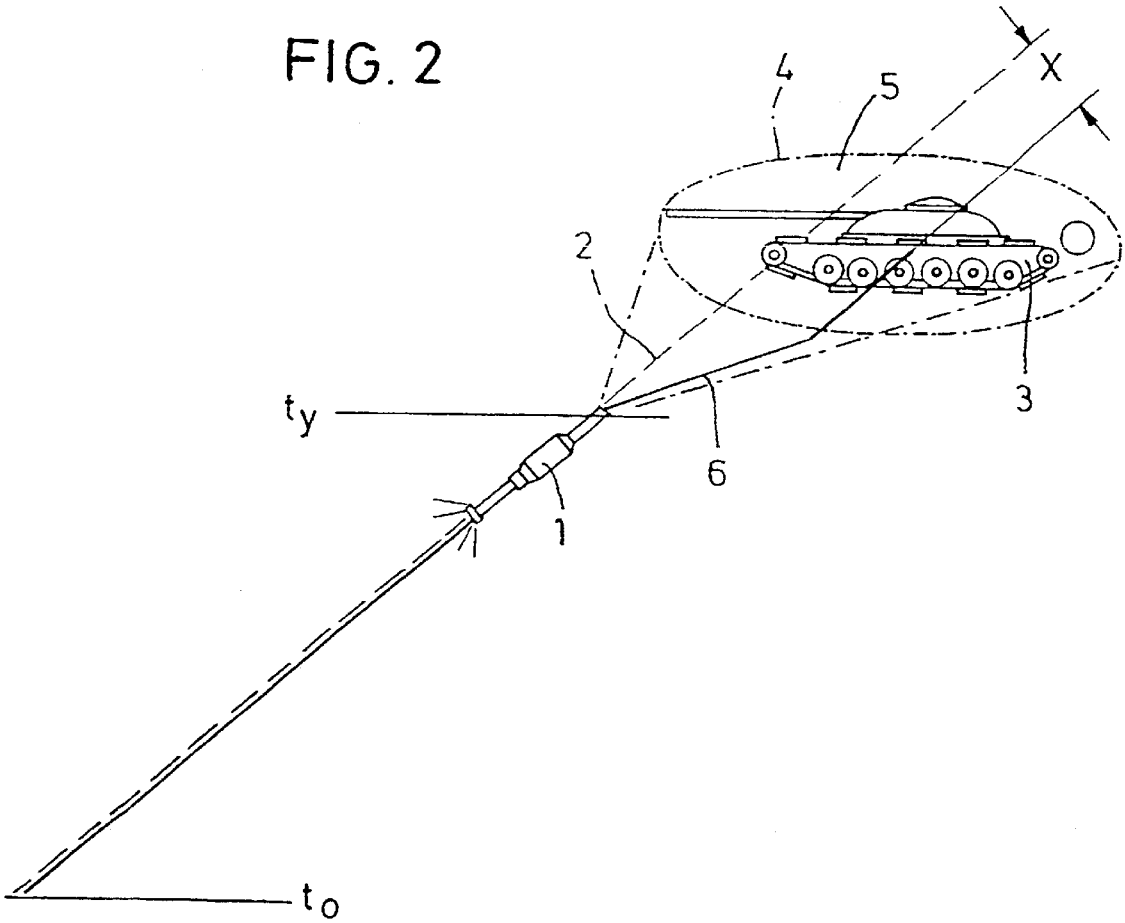
FIG. 2 is a schematic view of the guidance system of the present invention.

FIG. 2 shows the features of the guidance method in accordance with the invention. A missile 1 that is fired at the instant to flies along the line 2 in the direction of the tank 3. At the instant $t_y$, a sensor in the missile 1 is activated, the field of vision 4 of which sensor detects the tank 3 and also its immediate surrounding field 5. In the example shown in FIG. 2, the missile 1 would fly just past the tank 3. With the aid of a control mechanism, the flight-path 6 is therefore displaced by the amount X so that the tank 3 can be hit.

FIG. 3 shows a block diagram of the guidance method applied in FIG. 2. A laser range finder, which is fitted on the firing device, measures the distance to the tank, calculates the flying time to it with the aid of the theoretical flight path and retransmits this value to a timer in the missile. The latter activates the target sensor or the target sensors at a given time before the target. In a signal-processing electronics unit it is ascertained whether the target is hit or not. In the latter case, a trigger signal is transmitted to the control element as a function of the roll attitude of the missile.

FIG. 4 shows the embodiment of a weapon with which the guidance method in accordance with the invention is applied. A laser-range finder 8 with an aiming telescope 9 mounted thereon is located on a firing tube 7. The weapon has two handles 10, 11 and a shoulder rest 12. A safety lever 13 and a firing lever 14 are used for firing purposes. A transmitting antenna 15, which is connected to the laser-range finder 8 by cable, is also fitted on the firing tube 7. The warhead 16 of the missile 1, which is additionally plugged in the firing tube 7, consists of a hollow charge 17 and a guiding/control portion 18 which contains the target sensor, a roll-attitude sensor and also the control mechanism. The flying time determined by the laser-range finder 8 is transmitted to the guiding/control portion 18 in a contact-free manner by the antenna 15.

What is claimed is:

1. Guidance method for missiles which are fired directly at a target, comprising:

measuring the distance to the target before firing by means of a range finder;

calculating a flying time of a missile to the target on the basis of the distance to the target;

inputting the calculated flying time into the missile;

activating at least one sensor provided on the missile after a predetermined flying time shorter than the calculated flying time, processing data from the at least one sensor to ascertain whether the missile will fly past the target; and if it is ascertained that the missile will fly past the target within a correctable distance therefrom, carrying out a single trajectory adjustment by a fixed amount.

2. Guidance method according to claim 1, characterised in that the calculated flying time is input into the missile by a data transmission from the range finder to the missile in a contact-free manner.

3. Guidance method according to claim 1, characterised in that the at least one sensor is rigidly connected to the missile.

4. Guidance method according to claim 1, characterised in that a selected search range of at least one sensor is such that the target is detected as long as it is located in a trajectory-adjustment range of the missile.

5. Guidance method according to claim 1, characterised in that the at least one sensor ascertains the direction in which the single trajectory adjustment is to be effected.

6. Guidance method according to claim 1, wherein the missile is an anti-armour projectile.

7. A missile system for firing missiles directly at a target, comprising:

a missile having a war head, a charge and a guiding and control portion including a sensor for sensing the target;

a firing tube for firing the missile;

a range finder provided on the firing tube for measuring the distance to the target and calculating a flying time on the basis of the distance to the target;

a timer in the guiding and control portion for activating the sensor;

a transmitter for transmitting the calculated flying time to the timer on the missile;

a signal processor in the guiding and control portion for processing data from the sensor to ascertain whether the missile will fly past the target; and a control mechanism for carrying out a single trajectory adjustment by a fixed amount if it is ascertained that the missile will fly past the target within a correctable distance therefrom.

8. A missile system according to claim 7, wherein the transmitter is a wireless transmitter.

* * * * *